US008425009B2

(12) United States Patent
Okubo

(10) Patent No.: US 8,425,009 B2
(45) **Date of Patent: *Apr. 23, 2013**

(54) LIQUID EJECTING HEAD UNIT AND LIQUID EJECTING APPARATUS

(75) Inventor: Katsuhiro Okubo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 321 days.

This patent is subject to a terminal disclaimer.

(21) Appl. No.: 12/731,975

(22) Filed: Mar. 25, 2010

(65) Prior Publication Data

US 2010/0245481 A1 Sep. 30, 2010

(30) Foreign Application Priority Data

Mar. 26, 2009 (JP) ..... 2009-077840

(51) Int. Cl.
*B41J 2/14* (2006.01)
*B41J 2/16* (2006.01)

(52) U.S. Cl.
USPC ..... 347/50

(58) Field of Classification Search ..... None
See application file for complete search history.

(56) References Cited

U.S. PATENT DOCUMENTS

| | | | |
|---|---|---|---|
| 6,386,672 | B1 | 5/2002 | Kimura et al. |
| 7,156,507 | B2 | 1/2007 | Aruga et al. |
| 2003/0234845 | A1 | 12/2003 | Tominaga et al. |
| 2005/0062809 | A1 | 3/2005 | Yoshino et al. |
| 2006/0109319 | A1 * | 5/2006 | Momose ..... 347/71 |
| 2008/0198209 | A1 | 8/2008 | Mizoguchi et al. |

FOREIGN PATENT DOCUMENTS

| | | |
|---|---|---|
| JP | 05-246032 | 9/1993 |
| JP | 2002-361864 | 12/2002 |
| JP | 2004-181892 | 7/2004 |
| JP | 3606282 | 10/2004 |
| JP | 2005-319817 | 11/2005 |
| JP | 2008-200951 | 9/2008 |
| WO | 98-57809 | 12/1998 |
| WO | 03/141964 | 5/2003 |

OTHER PUBLICATIONS

U.S. Appl. No. 12/730,974, filed May 10, 2012, Office Action.

* cited by examiner

*Primary Examiner* — Matthew Luu
*Assistant Examiner* — Renee I Wilson
(74) *Attorney, Agent, or Firm* — Workman Nydegger

(57) ABSTRACT

A liquid ejecting head unit includes a head body which discharges liquid droplets; a wiring substrate which stands in a predetermined direction different from the discharging direction of the liquid from the head body in order to supply a driving signal, which drives the head body, to the head body; and a liquid flow channel unit which is disposed at a position overlapping with the wiring substrate in the predetermined direction, is integrally combined with the head body so that the flow channel is in direct communication with the head body, and includes a pressure chamber having a damper function of which at least a portion of wall surface is formed of a film member.

6 Claims, 4 Drawing Sheets

LIQUID EJECTING HEAD UNIT AND LIQUID EJECTING APPARATUS

BACKGROUND

1. Technical Field

The present invention relates to a liquid ejecting head unit and a liquid ejecting apparatus, and more particularly to those which are useful when applied to a system in which a liquid flow channel unit for supplying a liquid reserved in a liquid supply source to a head body is disposed on the way to a flow channel reaching the head body.

2. Related Art

As a representative example of the liquid ejecting head, for example, an ink jet recording head in which ink droplets are discharged from a nozzle opening by using a pressure created by a piezoelectric element displacement is known. In the ink jet recording head according to the related art, ink is supplied from the liquid supply source such as an ink cartridge filled with ink to the head body, and the ink supplied from the head body is discharged from a nozzle by driving a pressure generating means such as a piezoelectric element or a heating element. For example, by inserting an ink supply needle into the ink cartridge, ink in the ink cartridge is introduced to a pressure chamber side of the head body from an introducing hole of the ink supply needle.

Here, there is also provided a system in which the liquid flow channel unit is provided on the way to the flow channel which supplies ink from the liquid supply source such as the ink cartridge to the head body and constitutes the inkjet recording head unit along with the head body. The liquid flow channel unit, for example, fulfills a damper function which suppresses a pressure fluctuation such as a pulsation of liquid occurring due to inertial force acting on a liquid in a case in which the ink jet recording head unit is moved with a carriage. For this reason, the liquid flow channel unit is configured to form a pressure chamber in a flow channel by covering an opening portion in a body member having a liquid flow channel formed therein by a film member and, in a case in which a pulsation of liquid in the pressure chamber has occurred, to absorb the pulsation through a warp of the film member.

Furthermore, there is a related art which discloses a liquid flow channel unit having such a damper function (see, for example, Japanese Patent No. 3,606,282).

In the meantime, the liquid flow channel unit according to the related art is separately provided with a head body and is connected to the head body through another flow channel such as a tube. That is, it wan not configured to supply the liquid discharged from the liquid flow channel unit directly to a reservoir as a common liquid chamber of the head body. As a result, the ink jet recording head unit according to the related art having a liquid flow channel unit is forced to be large-scaled by as much.

Furthermore, such a problem is not limited to an ink jet recording head unit and is similarly present in a liquid ejecting head unit which ejects liquid other than ink.

SUMMARY

An advantage of some aspects of the invention is to provide a liquid ejecting head unit and a liquid ejecting apparatus which can promote an overall downsizing even in a case in which they are combined with a liquid flow channel unit.

According to a first aspect of the invention, there is provided a liquid ejecting head unit including: a head body which discharges liquid droplets; a wiring substrate which stands in a predetermined direction different from the discharging direction of the liquid from the head body in order to supply a driving signal, which drives the head body, to the head body; and a liquid flow channel unit which is disposed at a position overlapping with the wiring substrate in the predetermined direction, is integrally combined with the head body so that the flow channel is in direct communication with the head body, and includes a pressure chamber having a damper function of which at least a portion of a wall surface is formed of a film member.

In this aspect, since the liquid flow channel unit is provided adjacent to the wiring substrate which is naturally dead space or is standing from the head body in which a mere flow channel extending from the liquid flow channel unit to a common liquid chamber of the head body is formed, it is possible to use the area adjacent to the wiring substrate effectively and promote an overall miniaturization of the liquid ejecting head unit.

Here, the liquid flow channel unit can be disposed between the connecting substrate to which sides of the wiring substrate opposite to the head body are connected and the head body. In this case, it is possible to use the space between the connecting substrate and the head body effectively so as to provide the liquid flow channel unit.

In addition, the flow channel unit includes: a body member of resin having a protruding portion formed at a peripheral edge of the opening portion of the flow channel; the film member which receives a predetermined tension in a state in which the protruding portion is inserted into a hole portion to cover the opening portion; and a sealing member which is formed by integral molding of resin to interpose and fix the film member between it and the body member. In this case, since the film member is fixed to the body member in a state in which an appropriate tension is applied to the film member, it is possible to make the tension of the film member in the liquid flow channel unit be appropriate and to suppress the pulsation of liquid appropriately even though the liquid pulses with the movement of the pressure ejecting head unit. That is, a good damper effect can be exhibited. Also, fixing of the film member to the body member is performed by the sealing member of resin which is integrally molded with the body member of resin. That is, since fixing is not made by thermal welding, it is possible to form the body member with a commonly used resin without using of polypropylene resin. As a result, a liquid ejecting head unit including a liquid flow channel unit which is excellent in molding accuracy and heat distortion property and in which occurrence of burrs is seldom obtained.

Furthermore, the flow channel unit may be in contact with a driving circuit which is a heat generating portion mounted to the wiring substrate to exchange heat with a liquid flowing through the flow channel unit. In this case, it is possible to use the liquid flow channel unit as a cooling means of the driving circuit.

According to another aspect of the invention, there is provided a liquid ejecting apparatus including the liquid ejecting head unit as described above.

With this configuration, it is possible to effectively suppress the pulsation of liquid or the like with the movement of the carriage and to secure good printing quality. Also, since the size of the liquid ejecting head unit can be reduced, miniaturization of the liquid ejecting apparatus can also be accomplished.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings.

First Embodiment

Figure 1:
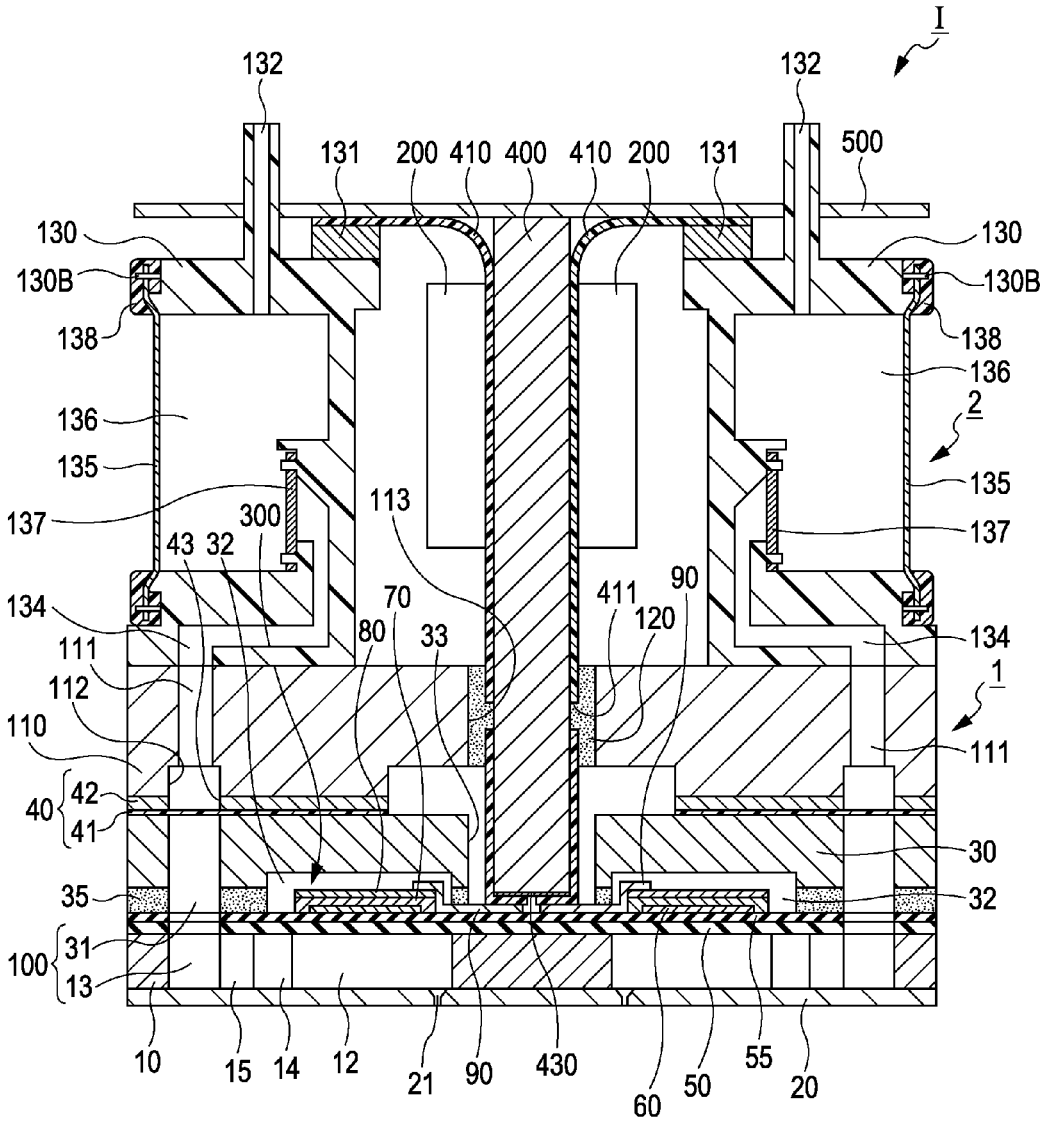
FIG. 1 is a sectional view showing an ink jet recording head unit according to a first embodiment of the invention.

FIG. 1 is a sectional view showing an ink jet recording head unit as one example of a liquid ejecting head unit according to a first embodiment of the invention. As shown in FIG. 1, the ink jet recording head unit I according to first embodiment (hereinafter, also referred to as a head unit I) includes two rows of ink jet recording heads 1 (hereinafter, also referred to as head body 1) which discharge ink droplets from a nozzle opening 21 to perform a desired printing and two liquid flow channel units 2 having a damper function which are disposed on the way to a flow channel supplying ink from a liquid supply source (not shown) such as an ink cartridge to the head body 1 and are integrally combined with the head bodies 1 respectively and correspondingly therewith. Here, two rows of the head bodies 1 and two liquid flow channel units 2 are similarly configured. In addition, the number of the head body 1 and the liquid flow channel unit 2 can be arbitrarily selected as necessary.

The flow channel forming substrate 10 of the head body 1 is in this embodiment composed of a silicon single crystal substrate having a face orientation of (110) and is provided with an elastic film 50 formed of silicon dioxide at one side thereof.

The flow channel forming substrate 10 includes two rows of a plurality of pressure generating chambers 12 which are divided by the partitioning walls and juxtaposed in a width direction of the flow channel forming substrate. In addition, a communication portion 13 is formed at a longitudinal outside area of each row of the pressure generating chambers 12, and the communication portion 13 and each of the pressure generating chambers 12 are connected to each other via an ink supply path 14 and a communication path 15 provided for every pressure generating chambers 12. The communication portion 13 is in communication with a reservoir portion 31 of a protecting substrate 30 which will be later described, and constitutes a portion of the reservoir 100 which is an ink chamber common to each row of the pressure generating chambers 12. The ink supply path 14 is formed in a width narrower than the pressure generating chamber 12, and maintains a flow channel resistance of the ink flowing into the pressure generating chamber 12 from the communication portion 13 to be constant.

Furthermore, although the ink supply path 14 is formed by narrowing the width of the flow channel from one side in this embodiment, the ink supply path may be formed by narrowing the width of the flow channel from both sides. In addition, the ink supply path may be formed by narrowing the flow channel from its thickness direction without narrowing the width of the flow channel. Moreover, each of the communication paths 15 is formed by extending the partitioning walls at both sides in a width direction of the pressure generating chamber 12 to the communication portion 13 side and dividing a space between the ink supply path 14 and the communication portion 13. That is, the flow channel forming substrate 10 is provided with the ink supply path 14 having a sectional area smaller than a widthwise sectional area of the pressure generating chamber 12 and the communication path 15 which is in communication with the ink supply path 14 and has a sectional area larger than a widthwise sectional area of the ink supply path 14, these paths being divided with a plurality of partitioning walls.

In addition, a nozzle plate 20 into which nozzle openings 21 in communication with the vicinity of the end of each pressure generating chamber 12 opposite to the ink supply path 14 are bored is fixed to an opening surface side of the flow channel forming substrate 10 by an adhesive or a thermal bonding film or the like. In this embodiment, in order to provide two rows of the pressure generating chambers 12 juxtaposed in the flow channel forming substrate 10, one head body 1 includes two rows of nozzles in which the nozzle openings 21 are juxtaposed. Furthermore, the nozzle plate 20 is, for example, constructed by a glass ceramic, a silicon single crystal or a stainless steel substrate or the like.

On the other hand, on a side of the above described flow channel forming substrate 10 opposite to the opening surface, an elastic film 50 is formed as described above, and an insulating film 55 is formed on the elastic film 50. Further, a first electrode 60, a piezoelectric layer 70 and a second electrode 80 are sequentially stacked over the insulating film 55 to form a piezoelectric element 300 as a pressure generating element according to the present embodiment. Here, the piezoelectric element 300 means a portion including the first electrode 60, the piezoelectric layer 70 and the second electrode 80. In general, either one side electrode of the piezoelectric element 300 is set to be a common electrode, and the other side electrode and the piezoelectric layer 70 are patterned for every pressure generating chamber 12. Next, here, a portion which is constructed by a patterned either side electrode and the piezoelectric layer 70 and at which a piezoelectric strain occurs by application of voltage to both electrodes is set to be a piezoelectric active portion. Although the first electrode 60 at the flow channel forming substrate 10 side is set to be a common electrode of the piezoelectric element 300 and the second electrode 80 is set to be an individual electrode of the piezoelectric element 300 in this embodiment, a reverse configuration for convenience of the driving circuit or wiring has no problem. In addition, here, the piezoelectric element 300 and a vibrating plate in which displacement occurs by the driving of the piezoelectric element 300 are collectively referred to as an actuator apparatus. Furthermore, although the elastic film 50, the insulating film 55 and the first electrode 60 serve as the vibrating plate in the above described example, the configuration of the vibrating plate is not limited to this. For example, only the first electrode 60 may serve as the vibrating plate without providing the elastic film 50 and the insulating film 55. In addition, the piezoelectric element 300 itself may substantially double as the vibrating plate.

The piezoelectric layer 70 is composed of a piezoelectric material exhibiting an electromechanical converting function formed on the first electrode 60, in particular, a ferroelectric material having a perovskite structure of all other piezoelectric materials. As the piezoelectric layer 70, one using a crystalline film having the perovskite structure is preferable. For example, the ferroelectric material such as a lead zirconium titanate (PZT) or a mixture formed by addition of a metal oxide such as a niobium oxide, a nickel oxide or a magnesium oxide to the ferroelectric material is preferable.

In addition, a lead electrode 90 extending to the above of the insulating film 55 and composed of, for example, gold (Au) or the like is connected to each of the second electrodes 80 which is an individual electrode of the piezoelectric element 300. One end of the lead electrode 90 is connected to the second electrode 80 and the other end side thereof extends between the rows in which the piezoelectric elements 300 are juxtaposed to each other.

A protecting substrate 30 having a reservoir portion 31 constituting at least a portion of the reservoir 100 is bonded via adhesive 35 onto the flow channel forming substrate 10 having the above described piezoelectric element 300 formed therein, that is, onto the first electrode 60, the elastic film 50 and the lead electrode 90. In this embodiment, the reservoir portion 31 is formed to penetrate the protecting substrate 30 in a thickness direction over the width direction of the pressure generating chamber 12, and is in communication with the communication portion 13 of the flow channel forming substrate 10 as described above to form the reservoir 100 which becomes an ink chamber common to each of the pressure generating chambers 12. Furthermore, although the communication portion 13 as a reservoir 100 is provided at the flow channel forming substrate 10 in this embodiment, the configuration is not particularly limited to this. For example, the communication portion 13 of the flow channel forming substrate 10 may be divided into plural ones for every pressure generating chambers 12 and only the reservoir portion 31 may be set to be a reservoir. In addition, for example, the flow channel forming substrate 10 may be provided with only the pressure generating chamber 12, and a member interposed between the flow channel forming substrate 10 and the protecting substrate 30 (for example, the elastic film 50, the insulating film 55 or the like) may be provided with the ink supply path 14 by which the reservoir 100 is in communication with each of the pressure generating chambers 12.

In addition, a piezoelectric element holding portion 32 as a holding portion having a space of the extent which does not inhibit the movement of the piezoelectric element 300 is provided to an area opposite to the piezoelectric element 300 of the protecting substrate 30. The piezoelectric element holding portion 32 may have a space of the extent which does not inhibit the movement of the piezoelectric element 300 and the space may be sealed or need not to be sealed. Furthermore, in this embodiment, since the piezoelectric elements 300 are juxtaposed in two rows, the piezoelectric element holding portion 32 is respectively provided in corresponding to each row of the juxtaposed piezoelectric elements 300. That is, two rows of piezoelectric elements 300 to which the piezoelectric element holding portions 32 are juxtaposed are provided in a row direction.

The protecting substrate 30 described above preferably uses a material having the same coefficient of thermal expansion as that of the flow channel forming substrate 10, for example, glass, ceramic material or the like and, in this embodiment, the protecting substrate is formed by using a silicone single crystal substrate of the same material as the flow channel forming substrate 10.

In addition, the protecting substrate 30 is provided with a through hole 33 which penetrates the protecting substrate 30 in a thickness direction. In this embodiment, the through hole 33 is provided between two piezoelectric element holding portions 32. A neighborhood of the end of the lead electrode 90 led out from each piezoelectric element 300 is provided to expose into the through hole 33.

The driving circuit 200 as IC for driving the piezoelectric element 300 is mounted to a COF substrate 410 which is a flexible wiring substrate. Here, the COF substrate 410 is bonded to a side surface of the holding member 400 having a plate shape of which a bottom end is connected to the lead electrode 90 and which stands substantially vertically. That is, the holding member 400 is a rectangular parallelepiped of which both sides are formed of vertical surfaces. In this embodiment, the wiring substrate is composed of these holding members 400, the COF substrate 410 and the driving circuit 200.

In more detail, in two head bodies 1 according to this embodiment, since a row in which the pressure generating chambers 12 are juxtaposed is respectively provided in the flow channel forming substrate 10, a row in which the piezoelectric elements 300 are juxtaposed in a width direction of the pressure generating chamber 12 (in a width direction of the piezoelectric element 300) is provided in two. That is, two rows of the pressure generating chambers 12, the piezoelectric elements 300 and the lead electrodes 90 are provided opposite to each other. The COF substrates 410 are respectively adhered to both side surfaces of the holding member 400 of which a lower portion is inserted into the through hole 33. Each of the COF substrates 410 has a bottom end which is connected to the end of the lead electrode 90 of each row of the piezoelectric elements 300 and the first electrode 60, and stands substantially vertically. In this embodiment, by providing one COF substrate 410 to each of the sides of the holding member 400, total two COF substrates 410 are provided to one holding member 400. As each of the COF substrates 410 stands substantially vertically as described above, a size of the lead electrode 90 and the first electrode 60 in a plane direction becomes small and thus the head is miniaturized.

Furthermore, since the COF substrate 410 as a flexible wiring substrate is easy to warp even if it stands as a single body, it is bonded to the holding member 400 as a rigid member to support the COF substrate 410 and thus can stand by suppressing the warp of the COF substrate 410. Of course, without providing the holding member 400, only the COF substrate 410 may be provided to erect in a direction to cross at right angles to a plane in which the piezoelectric element 300 of the flow channel forming substrate 10 is provided. In addition, although the COF substrate 410 is configured to be adhered to a side surface 400 of the holding member 400, the configuration is not particularly limited to this. For example, the COF substrate 410 may be held to fall on the holding member 400.

Furthermore, a buffering member 430 which can be preferably formed of Teflon (registered trademark) or the like is provided between the bottom surface of the holding member 400 and a bottom end of the COF substrate 410. In addition, the bottom end of the COF substrate 410 and the lead electrode 90 are electrically connected to each other by the conducting particles (for example, contained in anisotropic conducting material such as an anisotropic conducting film (ACF) or an anisotropic conducting paste (ACP)). That is, by screw-down of the holding member 400, via the bottom end face of the holding member, the COF substrate 410 is pressed to a lead electrode 90 side. As a result, the conducting particles are mashed to perform a desired electrical connection of the COF substrate 410 and the lead electrode 90. At this time, the buffering member 430 functions to equalize a pressing force to the COF substrate 410. Here, it is preferable to set a bottom end face of the holding member 400 and a bottom end of the COF substrate 410 or a bottom end face of the holding member 400 in abutment with the buffering member 430 to an order of surface accuracy within five times of the particle diameter of the conducting particles. The reason is that as a result of this, it is possible to equalize the pressing force acting on the conducting particles via the bottom end of the COF substrate 410 together with the presence of the buffering member 430 and to secure a good electrical connection by mashing the conducting particles reliably. Of course, the connection of the bottom end of the COF substrate 410 and the lead electrode 90 are not limited to the conducting particles. For example, the connection of the both elements may be performed by melting a metal material such as a solder.

In addition, it is preferable that the holding member 400 has a thermal conductivity capable of heat dissipating so that a temperature of the driving circuit 200 becomes lower than its junction temperature even in a case in which the head body 1 is used at its highest use-guaranteed temperature. As a result, it is possible to contribute to a lasting stable driving of the driving circuit by exerting a sufficient heat dissipating effect even if the driving circuit is operated under a most harsh load condition. For this reason, the holding member 400 according to this embodiment is formed of SUS as materials. In this case, as a result that the heat generated by the driving circuit 200 can be absorbed via the flow channel forming substrate 10 to the ink flowing in the inside of the substrate 10 by the holding member 400, it is possible to effectively dissipate the heat generated by the driving circuit 200. The same acting effect can be accomplished by making a distance between the surface of the flow channel forming substrate 10 and the driving circuit 200 sufficiently small even in a case in which the metal such as SUS is not used as the material. That is, it is preferable to set the distance between the driving circuit 200 and the surface of the flow channel forming substrate 10 as a distance which can dissipate the heat so that the temperature of the driving circuit 200 becomes lower than its junction temperature even in a case in which the head body 1 is used at its highest use-guaranteed temperature.

Furthermore, such a holding member 400 is preferably formed by a material having the same linear expansion coefficient as that of the head case 110 as a holding member which will be described in detail, and examples of the material include, for example, a stainless steel or silicon or the like.

In addition, a compliance substrate 40 composed of a sealing film 41 and a fixing plate 42 is bonded onto the protecting substrate 30. Here, the sealing film 41 is formed of a material having flexibility with low rigidity (for example, poly phenylene sulfide (PPS) film), and one side surface of the reservoir portion 31 is sealed by the sealing film 41. In addition, the fixing plate 42 is formed of hard material such as metal (for example, stainless steel (SUS) or the like). Since an area of the fixing plate 42 opposite to the reservoir 100 is an opening portion 43 which is completely removed in a thickness direction, one side surface of the reservoir 100 is sealed by only the sealing film 41 having flexibility.

The head case 110 as a holding member is provided on the compliance substrate 40. An ink introducing path 111 which is in communication with the ink introducing port 44 and supplies ink from the reserving means such as a cartridge to the reservoir 100 is provided to the head case 110.

Here, the ink introducing path 111 is in communication with the ink discharging port 134 of the liquid flow channel unit 2 and the ink is supplied from the liquid supply source such as the ink cartridge (not shown) through the liquid flow channel unit 2 to the reservoir 100.

In addition, a recess 112 is formed at an area of the head case 110 opposite to the sealing film 41 and, with the presence of the recess 112, a flexural deformation of the sealing film 41 is appropriately performed. Further, the head case 110 is provided with a wiring member holding hole 113 which is in communication with the through hole 33 provided in the protecting substrate 30 and, in a state in which the COF substrate 410 and the holding member 400 are inserted into the wiring member holding hole 113, a bottom end of the COF substrate 410 is connected with the lead electrode 90. The COF substrate 410 and the holding member 400 inserted into the wiring member holding hole 113 of the head case 110 are fixed to the head case 110 by adhesive 120. Here, although the head case 110 and the COF substrate 410 may be bonded to each other via the adhesive 120, a direct bonding of the head case 110 and the holding member 400 can make the holding member 400 be reliably held in the head case 110. That is, by bonding the members having high rigidity of the head case 110 and the holding member 400 to each other, it is possible to maintain a state in which the COF substrate 410 and the lead electrode 90 are reliably connected to each other and to prevent a trouble in which connection of the COF substrate 410 and the lead electrode 90 is severed and thus disconnected or the like from occurring. Accordingly, in this embodiment, the holding holes 411 penetrating the COF substrate 410 in a thickness direction are provided at a predetermined interval in a juxtaposed direction of the lead electrode 90, and the head case 110 and the holding member 400 are bonded to each other through the holding holes 411 by the adhesive 120. In addition, when directly bonding the head case 110 and the holding member 400, it is preferable to form the head case 110 and the holding member 400 with a material having the same linear expansion coefficient. In this embodiment, by forming the head case 110 and the holding member 400 with a stainless steel, it is possible to prevent warpage or breakage of the head case 110 and the holding member 400 due to the difference in their linear expansion coefficients when the head case 1 expands or contracts. Incidentally, if the head case 110 and the holding member 400 are formed by using the materials having different linear expansion coefficients, there is a possibility that the holding member 400 will press the flow channel forming substrate 10 and thus crack will occur in the flow channel forming substrate 10. Further, it is more preferable that the head case 110 and the holding member 400 are formed with a material having the same linear expansion coefficient as that of the protecting substrate 30 to which these members are fixed.

In each of the head body 1 as described above, each of the COF substrates 410 extends to a side (an upper side in drawing) opposite to the ink discharge surface to which the nozzle opening 21 is opened, and each of the tip ends thereof is horizontally bent and connected to a connecting substrate 500. In more detail, the tip end of the COF substrate 410 is put on the top surface of the body member 130 of the liquid flow channel unit 2 via a pad member 131, and the connecting substrate 500 is connected to the each of the tip end lying in such state from above. As a result, the space which is provided above the head case 110, is adjacent to the COF substrate 410 and is provided below the connecting substrate 500 is naturally a dead space. In this embodiment, the space is used to arrange the liquid flow channel unit 2. That is, the liquid flow channel unit 2 is put on the head case 110 under the connecting substrate 500 and, as will be later described, its flow channel is in direct communication with the reservoir 100 of the head body 1.

Here, the liquid flow channel 2 discharges the ink, which has been introduced from the liquid supply source such as the reservoir 100 via the ink introducing port 132, from an ink discharge port 134 toward the reservoir 100, and thus it constitutes a portion of the path extending from the liquid supply path to the head body 1. Here, the ink introducing port 132 penetrates the connecting substrate 500 and protrudes upward from the space between the head body 1 and the connecting substrate 500. In this state, a tube or the like (not shown) to introduce ink from the ink supply source is connected. In addition, the liquid flow channel unit 2 is put on the head case 110 in a state in which a bottom surface of the body member 130 is in direct contact with the surface of the head case 110, and is configured so that the ink discharging port 134 is in direct communication with the ink introducing path 111.

Further, the liquid flow channel unit 2 also functions as a damper which suppresses the pulsation of the ink introduced via the ink introducing port 132. Thus, a pressure chamber 136 formed by covering the opening portion 130A of the flow channel of the body member 130 by the film member 135 is provided, and thus it is possible to suppress the pulsation of ink through a warp of the film member 135 in a case in which the ink reserved in the pressure chamber 136 fluctuates by the vibration from the outside.

In more detail, the body member 130 has an opening portion 130A at one surface where the ink flows. The body member 130 is a resin container having a protruding portion 130B formed at a periphery of the opening portion 130A (not shown) and is molded by a conventional resin (for example, PPS, PPE, Hi-PS alloy) which can resin mold with accuracy and high precision even a small-sized product. The film member 135 receives a predetermined tension in a state in which the protruding portion 130B is inserted into a hole portion 135A (not shown) to cover the opening portion 130A, and the film member 135 is interposed and fixed by the body member 130 and the sealing member 138. The sealing member 138 is formed by integral molding of resin between it and the body member 130. As a result, a pressure chamber 136 partitioned by the film member 135 to which a predetermined tension is applied is formed. Furthermore, a filter 137 to finally remove foreign matters from the ink supplied to the reservoir 100 is provided on the way to the flow channel unit 2.

In this embodiment as described above, the ink supplied from the liquid supply source such as the ink cartridge is supplied to the reservoir 100 of the head body 1 via the liquid flow channel unit 2. Thus, in the head body 1, the ink flown from the reservoir 100 is discharged from the pressure generating chamber 12 through the nozzle opening 21 by driving of the piezoelectric element 300.

Here, the liquid flow channel unit 2 functions as an ink flow channel extending from the liquid supply source to the head body 1 and also functions as a damper. In other words, the liquid flow channel unit 2 which is a portion of the flow channel and functions as the damper is provided in a space between the connecting substrate 500 of the head body 1 and the head body 1. Accordingly, it is possible to promote effective use of the space and contribute the miniaturization of the head unit I. Incidentally, the space between the connecting substrate 500 and the head body 1 becomes inevitably necessary for the reasons that the substrate 410 is standing or the like. Also, some of the heat emitted from the driving circuit 200 as an IC is absorbed by the liquid flow channel unit 2. Here, in order to positively prevent an increase in the temperature due to the heat generation from the driving circuit 200, the driving circuit 200 may be configured to be in directly contact with the body member 130 of the liquid flow channel unit 2. In this case, more preferable heat absorption by the liquid flow channel unit 2 is performed.

Figure 2C:
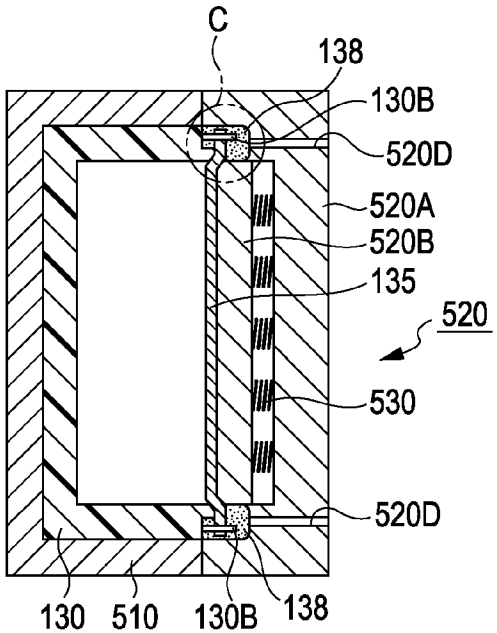
FIGS. 2A to 2C are explanatory views conceptually illustrating a manufacturing method of a liquid flow channel unit according to the first embodiment.
Figure 2B:
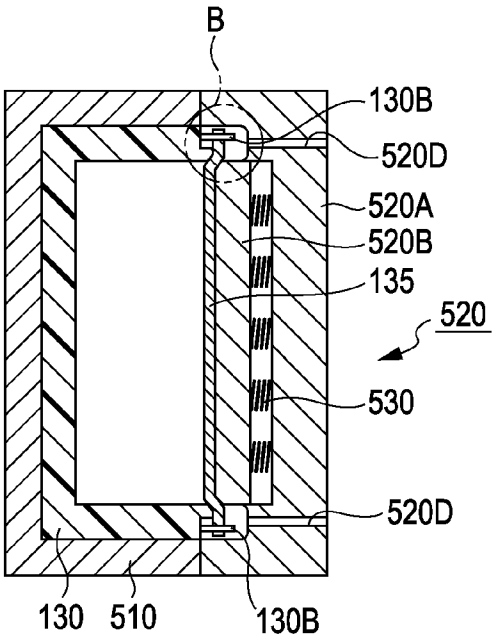
Figure 2A:
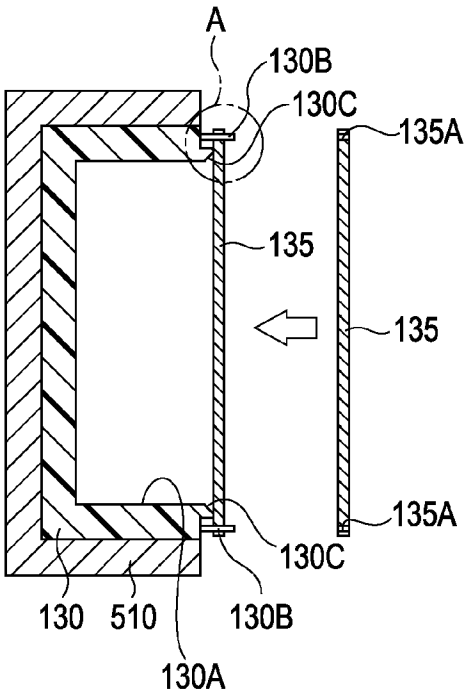
Figure 3A:
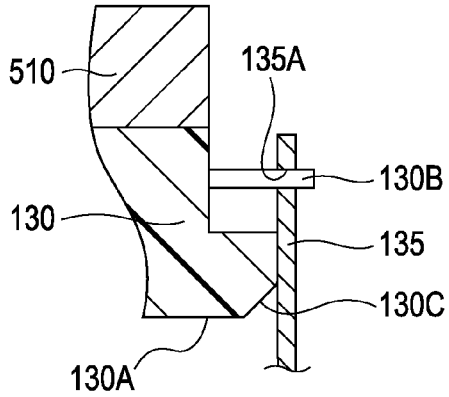
FIGS. 3A to 3C are enlarged views showing the selected portions of FIGS. 2A to 2C.

Here, one example of the manufacturing method of small-sized and accurate liquid flow channel unit 2 according to the present embodiment is described. FIGS. 2A to 2C are explanatory views conceptually illustrating the manufacturing method. As shown in FIG. 2A and FIG. 3A which is an enlarged view showing the A portion in FIG. 2A, the flow channel is formed by molding by separate molds, and the protruding portion 130B of the resin body member 130 accommodated into the mold 510 to which the filter 137 or the like has been mounted is inserted into the hole portion 135A provided in the film member 135 so that the opening portion 130A is covered by the film member 135.

Next, as shown in FIG. 2B, a mold 510 abuts against another mold 520. The mold 520 is composed of an outside mold 520A having a container shape and an inside mold 520B which is accommodated into the outside mold 520A and slightly protrudes from an opening end face of the outside mold 520A. The inside mold 520B is mounted to the outside mold 520A via a spring 530 and its surface which substantially corresponds to a shape of the opening portion 130A of the body member 130 abuts against the film member 135.

Accordingly, as the mold 520 comes into contact with the mold 510, the inside mold 520B abuts against a portion of the film member 135 corresponding to the opening portion 130A and presses it toward the flow channel. Therefore, the film member 135 covering the opening portion 130A as described above is pressed toward the flow channel to apply a desired tension. Here, a wall surface portion as a boundary with the opening portion 130A in the body member 130 is provided with a chamfered portion 130C which promotes relaxation of the stress concentrated at the film member 135 in the boundary portion.

Figure 3B:
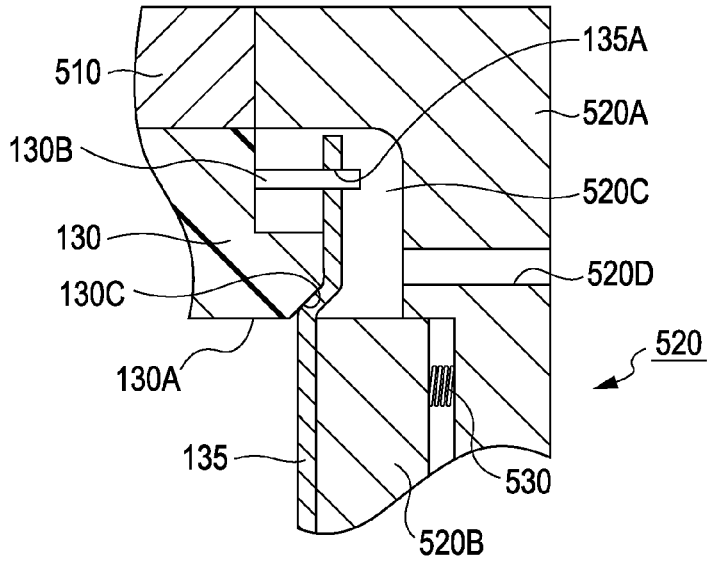

On the other hand, as shown in FIG. 2B and FIG. 3B which is an enlarged view showing the B portion in FIG. 2B, the end face of the outside mold 520A is provided with a space 520C corresponding to an outer shape of the sealing portion 138, and the space 520C is configured so that it can be filled with resin. Here, the space 520C has a shape which can pour the resin into an outside of the peripheral portion of the film member 135 to fill it.

Figure 3C:
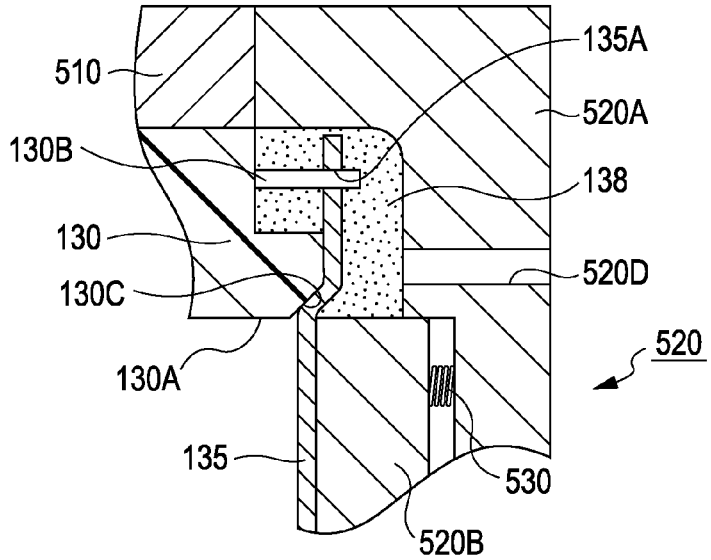

Finally, as shown in FIG. 2C and FIG. 3C which is an enlarged view showing the C portion in FIG. 2C, the sealing portion 138 is integrally molded by pouring the resin via the resin pouring port 520D into a space 520C which is a periphery portion of the film member 135 in a state in which the tension is applied. As a result, it is possible to interpose and fix the film member 135 between the sealing member 138 and the body member 130.

Thus, even if the film member 135 slightly expands by the heat accompanied by the resin pouring in molding the last sealing member 138, it is possible to apply an appropriate tension to the film member 135 in a portion corresponding to the opening portion 130A. As a result, since the film member 135 is fixed to the body member 130 under the application of a constant tension without going slack, it can exhibit a stable damper effect over long period.

Furthermore, if the mold 520 is configured such that a surface in abutment with the opening 130A protrudes slightly forward than its peripheral surface instead of the configuration in which the mold 520 has a double structure as described above, it is possible to exhibit the same function even with an integral mold. However, as shown in FIGS. 2A to 2C, in a case of mounting via the spring 530, it is possible to adjust the pressing force with respect to the film member 135 to an optimal pressing force. In addition, when molding the sealing member 138, although the pouring the resin into the outside of the periphery of the film member 135 to fill it is also not indispensable, with such a molding, it is possible to perform a reliable sealing so that an ink does not leak from the pressure chamber 136, along with the fixing of the film member 135 by the sealing member 138.

The above described liquid flow channel unit 2 is fixed onto the head case 110 by adhesive.

Other Embodiment

Furthermore, although the head body 1 having an actuator apparatus formed by a thin film type piezoelectric element 300 is described as a pressure generating element to create a pressure change in the pressure generating chamber 12 in the first embodiment, the configuration is not limited to this. For example, the head body using an actuator apparatus of the thick film type formed by a method such as application of a green sheet or an actuator apparatus of the longitudinal vibration type in which the piezoelectric material and the electrode forming material are alternately stacked and axially expanded or contracted may be used. In addition, as the pressure generating element, one in which a heat generating element is disposed in the pressure generating chamber and droplets are discharged from the nozzle opening by the bubbles generated by the heat from the heat generating element, or a so-called electrostatic type actuator in which a static electricity is generated between the vibrating plate and the electrode and an electrostatic force causes the vibrating plate to deform and the droplets to be discharged from the nozzle opening, or the like may be used.

In addition, although two rows of the pressure generating chambers 12 juxtaposed in the flow channel forming substrate 10 are provided in the above described embodiment, the number of the row is not limited to a particular number in this case. The number of the row may be one, two, three or more. In the case in which the number of the rows is plural, it is preferable that two rows constituting a pair are oppositely provided.

Although the case in which the liquid flow channel unit 2 includes only the filter 137 is described in the first embodiment, it may have a self-sealing function. Here, the self-sealing function means a function to supply ink to the reservoir 100 via the ink discharging port 134 only when the head body 1 side is under a negative pressure, and is realized by providing an open/close valve which opens the flow channel only when the head body 1 side is under a negative pressure into the flow channel of the liquid flow channel unit 2.

Figure 4:
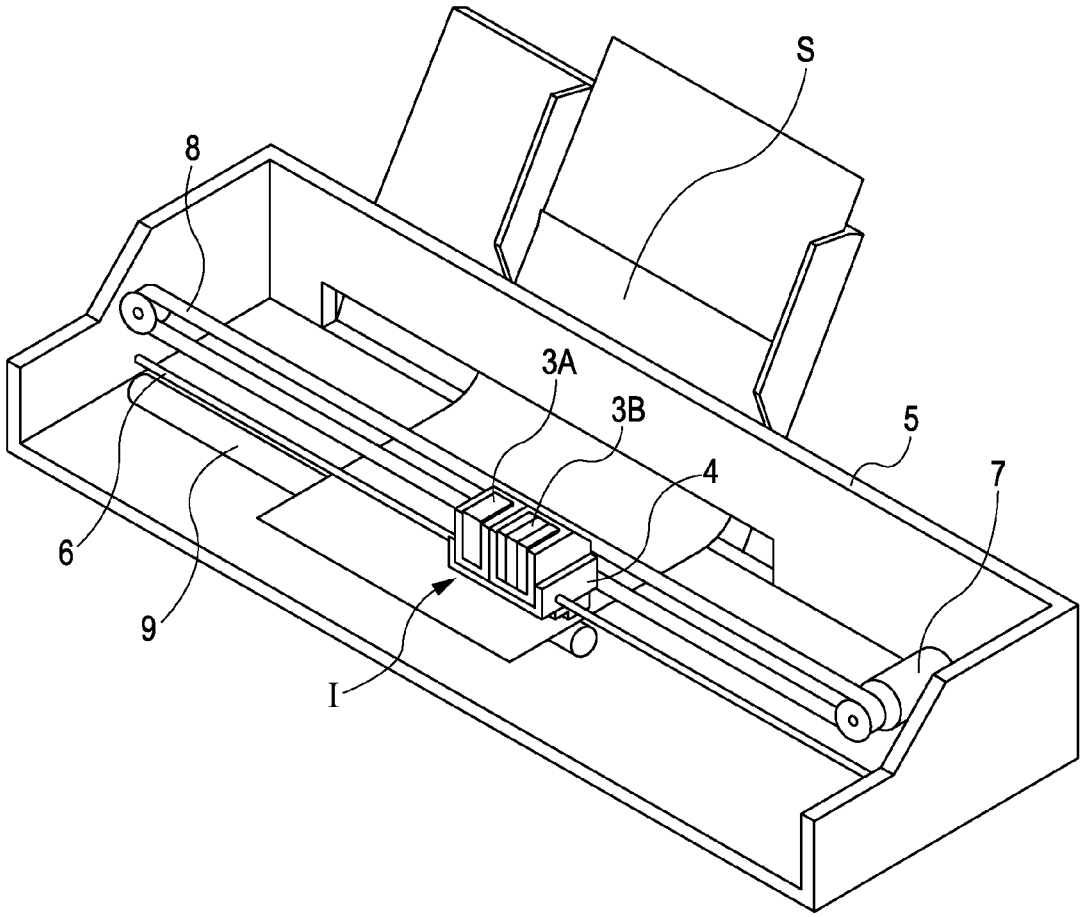
FIG. 4 is a schematic view showing an ink jet recording apparatus according to the first embodiment.

Furthermore, the head unit I according to the first embodiment is mounted to the ink jet recording apparatus. FIG. 4 is a schematic view showing one example of the ink jet recording apparatus. As shown, the head unit I according to the first embodiment is configured such that the cartridges 3A and 3B constituting the ink supply means are detachably provided thereto, and a carriage 4 having the head unit I mounted thereto is provided on a carriage shaft 6 attached to the apparatus body 5 to be able to axially move. The head unit I is set, for example, as one that discharges a black ink composition and a color ink composition.

Since the driving force of a driving motor 7 is transferred via a plurality of gears (not shown) and a timing belt 8 to the carriage 4, the carriage 4 having the head unit I mounted thereto moves along the carriage shaft 6. On the other hand, the apparatus body 5 is provided with a platen 9 along the carriage shaft 6, and the recording sheet S as a recording medium such as a paper fed by a paper feeding roller (not shown) or the like is put on the platen 9 and transferred.

In addition, flow channel structure or material or the like is not limited to the above described configuration.

Furthermore, although the ink jet recording head is described as an example of the liquid ejecting head in the above embodiments, the invention broadly relates to a general liquid ejecting head and, of course, can be applied to a liquid ejecting head which ejects liquids other than ink. As other examples of the liquid ejecting head, for example, various recording head used in the image recording apparatus such as a printer, a color ejecting head used in manufacturing the color filter of liquid crystal display or the like, an electrode material ejecting head used in forming an electrode of an organic EL display, a FED (field emission display) or the like, a bioorganic material ejecting head used in manufacturing a biochip or the like are included.

What is claimed is:

1. A liquid ejecting head unit, comprising:

a head body which discharges liquid droplets;

a wiring substrate which stands in a predetermined direction different from the discharging direction of the liquid from the head body in order to supply a driving signal, which drives the head body, to the head body; and a liquid flow channel unit which is disposed at a position overlapping with the wiring substrate in the predetermined direction, is integrally combined with the head body so that the flow channel is in direct communication with the head body, and includes a pressure chamber having a damper function of which at least a portion of a wall surface is formed of a film member, wherein the liquid flow channel unit includes:

a body member of resin having a protruding portion formed at a peripheral edge of the opening portion of the flow channel;

the film member which receives a predetermined tension in a state in which the protruding portion is inserted into a hole portion to cover the opening portion; and a sealing member which is formed by integral molding of resin to interpose and fix the film member between it and the body member.

2. The liquid ejecting head unit according to claim 1, wherein the liquid flow channel unit is disposed between a connecting substrate to which sides of the wiring substrate opposite to the head body are connected and the head body.

3. The liquid ejecting head unit according to claim 1, wherein the liquid flow channel unit is in contact with a driving circuit which is a heat generating portion mounted to the wiring substrate to exchange heat with a liquid flowing through the liquid flow channel unit.

4. A liquid ejecting apparatus comprising:

a liquid ejecting head unit that includes:

a head body which discharges liquid droplets;

a wiring substrate which stands in a predetermined direction different from the discharging direction of the liquid from the head body in order to supply a driving signal, which drives the head body, to the head body; and a liquid flow channel unit which is disposed at a position overlapping with the wiring substrate in the predetermined direction, is integrally combined with the head body so that the flow channel is in direct communication with the head body, and includes a pressure chamber having a damper function of which at least a portion of a wall surface is formed of a film member, wherein the liquid flow channel unit includes:

a body member of resin having a protruding portion formed at a peripheral edge of the opening portion of the flow channel;

the film member which receives a predetermined tension in a state in which the protruding portion is inserted into a hole portion to cover the opening portion; and a sealing member which is formed by integral molding of resin to interpose and fix the film member between it and the body member.

5. The liquid ejecting apparatus according to claim 4, wherein the liquid flow channel unit is disposed between a connecting substrate to which sides of the wiring substrate opposite to the head body are connected and the head body.

6. The liquid ejecting apparatus according to claim 4, wherein the liquid flow channel unit is in contact with a driving circuit which is a heat generating portion mounted to the wiring substrate to exchange heat with a liquid flowing through the liquid flow channel unit.

* * * * *